US010980685B2

(12) United States Patent
Benedini

(10) Patent No.: US 10,980,685 B2
(45) Date of Patent: Apr. 20, 2021

(54) CONNECTION ASSEMBLY FOR COUPLING AN AUXILIARY DRIVE SYSTEM TO A WHEELCHAIR FOR DISABLED PEOPLE

(71) Applicant: KLAXON MOBILITY GMBH, Villach (AT)

(72) Inventor: Antonio Benedini, Ponte di Barbarano (IT)

(73) Assignee: Klaxon Mobility GMBH, Villach (AT)

( * ) Notice: Subject to any disclaimer, the term of this patent is extended or adjusted under 35 U.S.C. 154(b) by 191 days.

(21) Appl. No.: 16/069,458

(22) PCT Filed: Mar. 31, 2017

(86) PCT No.: PCT/IB2017/051860

§ 371 (c)(1),
(2) Date: Jul. 11, 2018

(87) PCT Pub. No.: WO2017/175103

PCT Pub. Date: Oct. 12, 2017

(65) Prior Publication Data

US 2019/0015272 A1 Jan. 17, 2019

(30) Foreign Application Priority Data

Apr. 6, 2016 (IT) ..... 102016000035038

(51) Int. Cl.
*A61G 5/04* (2013.01)
*A61G 5/10* (2006.01)

(52) U.S. Cl.
CPC ..... *A61G 5/047* (2013.01); *A61G 5/1051* (2016.11)

(58) Field of Classification Search
CPC ..... A61G 5/047; A61G 5/10; A61G 5/1051
See application file for complete search history.

(56) References Cited

U.S. PATENT DOCUMENTS

| | | | | |
|---|---|---|---|---|
| 4,503,925 A * | 3/1985 | Palmer | ..... | A61G 5/047 180/13 |
| 5,494,126 A | 2/1996 | Meeker | | |
| 7,216,728 B2 * | 5/2007 | Huang | ..... | A61G 5/047 180/13 |
| 7,976,049 B2 * | 7/2011 | Chiu | ..... | A61G 5/047 180/13 |

(Continued)

OTHER PUBLICATIONS

International Search Report and Written Opinion dated Jun. 26, 2017, issued in PCT Application PCT/IB2017/051860, fled Mar. 31, 2017.

*Primary Examiner* — Minnah L Seoh
*Assistant Examiner* — Maurice L Williams
(74) *Attorney, Agent, or Firm* — Workman Nydegger

(57) ABSTRACT

A connection assembly for coupling an auxiliary drive system to a wheelchair for disabled people, of the type comprising a fixing structure adapted to be fixed to the framework of the wheelchair and a longitudinal member operatively connected to the fixing structure so that the longitudinal development axis of the longitudinal member is substantially parallel to the advancement direction of the wheelchair. The connection assembly comprises connection means associated with the free end of the longitudinal member and with the auxiliary drive system, such connection means are configured to allow rapid coupling and decoupling of the auxiliary drive system to/from the wheelchair.

13 Claims, 12 Drawing Sheets

(56) References Cited

U.S. PATENT DOCUMENTS

| | | | | |
|---|---|---|---|---|
| 9,326,901 | B2 * | 5/2016 | Conte | A61G 5/047 |
| 2008/0115982 | A1 * | 5/2008 | Lin | A61G 5/1051 180/13 |
| 2011/0095508 | A1 | 4/2011 | Chiu | |

* cited by examiner

CONNECTION ASSEMBLY FOR COUPLING AN AUXILIARY DRIVE SYSTEM TO A WHEELCHAIR FOR DISABLED PEOPLE

BACKGROUND OF THE INVENTION

1. The Field of the Invention

The invention relates to a connection assembly configured for coupling an auxiliary drive system to a wheelchair for disabled people.

The invention also relates to the auxiliary drive system comprising the connection assembly of the invention.

2. The Relevant Technology

It is known that people with motor problems to the lower limbs have the need to use special wheelchairs for the disabled in order to be able to move in an autonomous or semi-autonomous manner.

It is also known that such wheelchairs for the disabled comprise a framework on which a seat is formed for the disabled and to which a pair of rear drive wheels and a pair of adjustable front wheels are rotatably coupled.

Moreover, it is known that in order to advance a wheelchair, the disabled user has to manually act on the above rear wheels so as to exert a thrust on them and place them in rotation.

However, such a simple configuration of manual wheelchairs does not allow, disadvantageously, the disabled person to walk long distances as the effort required would be excessive.

Moreover, a large number of people with motor problems to the lower limbs have as many problems of mobility of the upper limbs, thus making it very difficult if not impossible to autonomously use the above manual wheelchairs for disabled people.

SUMMARY OF THE INVENTION

In order to overcome these problems, motorized wheelchairs for the disabled were developed and placed on the market in the past, i.e. provided with an electric motor adapted to place in rotation the rear wheels, a battery pack for powering said electric motor and a driving system controllable by the disabled person to control the functionality of the wheelchair.

However, these types of wheelchairs for disabled people have two main drawbacks.

A first recognized drawback lies in that motorized wheelchairs for the disabled have a non-negligible and much higher cost than manual wheelchairs.

Moreover, motorized wheelchairs for the disabled have large overall dimensions and make certain movements and certain procedures normally feasible with the use of manual wheelchairs impossible.

For example, with a motorized wheelchair it would be impossible for a disabled person to autonomously use the car and load the wheelchair itself therein, as it happens with manual foldable wheelchairs.

In order to obtain a compromise between these two solutions, auxiliary drive systems have been developed over the last decade to be coupled at the front to manual wheelchairs for the disabled so as to make the latter motorized.

In particular, such auxiliary drive systems of a known type may comprise a tubular column and a steering assembly in turn comprising a steering tube rotatably inserted into said tubular column. At the first end thereof, the steering column is associated with a wheel and at the second end it is associated with steering means, such as a handlebar.

Moreover, auxiliary drive systems of known type comprise motion generating means, preferably an electric motor with relative battery pack, associated with the wheel so as to actuate the rotation thereof.

Moreover, the auxiliary drive systems of the prior art necessarily need to comprise a connection assembly in order to obtain a stable and safe connection with the above wheelchair.

However, all known types of auxiliary drive systems applicable to a wheelchair for disabled people have a recognized drawback associated to the above connection assemblies.

In particular, the above prior art connection assemblies do not allow carrying out the coupling and decoupling between the auxiliary drive system and the wheelchair in a sufficiently quick and especially simple manner, considering all the problems of a motor nature that people with disabilities could have.

The present invention aims to overcome all of the above drawbacks.

In particular, one of the objects of the invention is to provide a connection assembly for coupling an auxiliary drive system to a wheelchair which allows carrying out the coupling and decoupling operations quickly and easily for a disabled person, whatever his/her motor problem.

Another object of the invention is to implement a connection assembly that allows achieving a robust and stable coupling between the auxiliary drive system and the wheelchair.

The above objects are achieved by implementing a connection assembly according to the main claim.

Further features of the connection assembly of the invention are described in the dependent claims.

The auxiliary drive system according to claim 10 is also part of the invention.

BRIEF DESCRIPTION OF THE DRAWINGS

The above objects, along with the advantages that will be mentioned hereinafter, will appear clearly from the description of some preferred embodiment variants of the invention which is made by way of non-limiting example with reference to the accompanying drawings, in which.

DETAILED DESCRIPTION OF THE PREFERRED EMBODIMENTS

Figure 1:
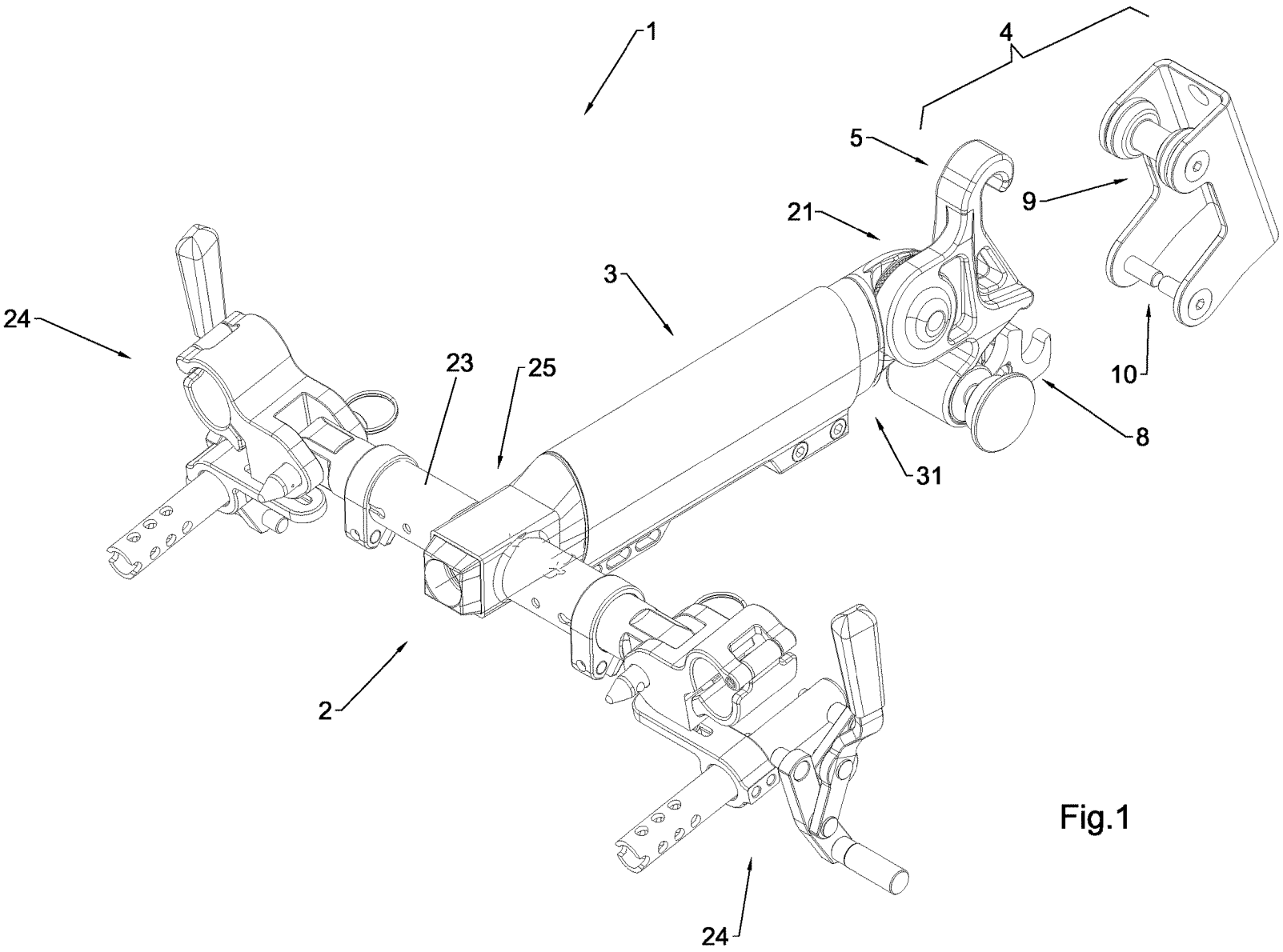
FIG. 1 shows an isometric view of the connection assembly of the invention.
Figure 2:
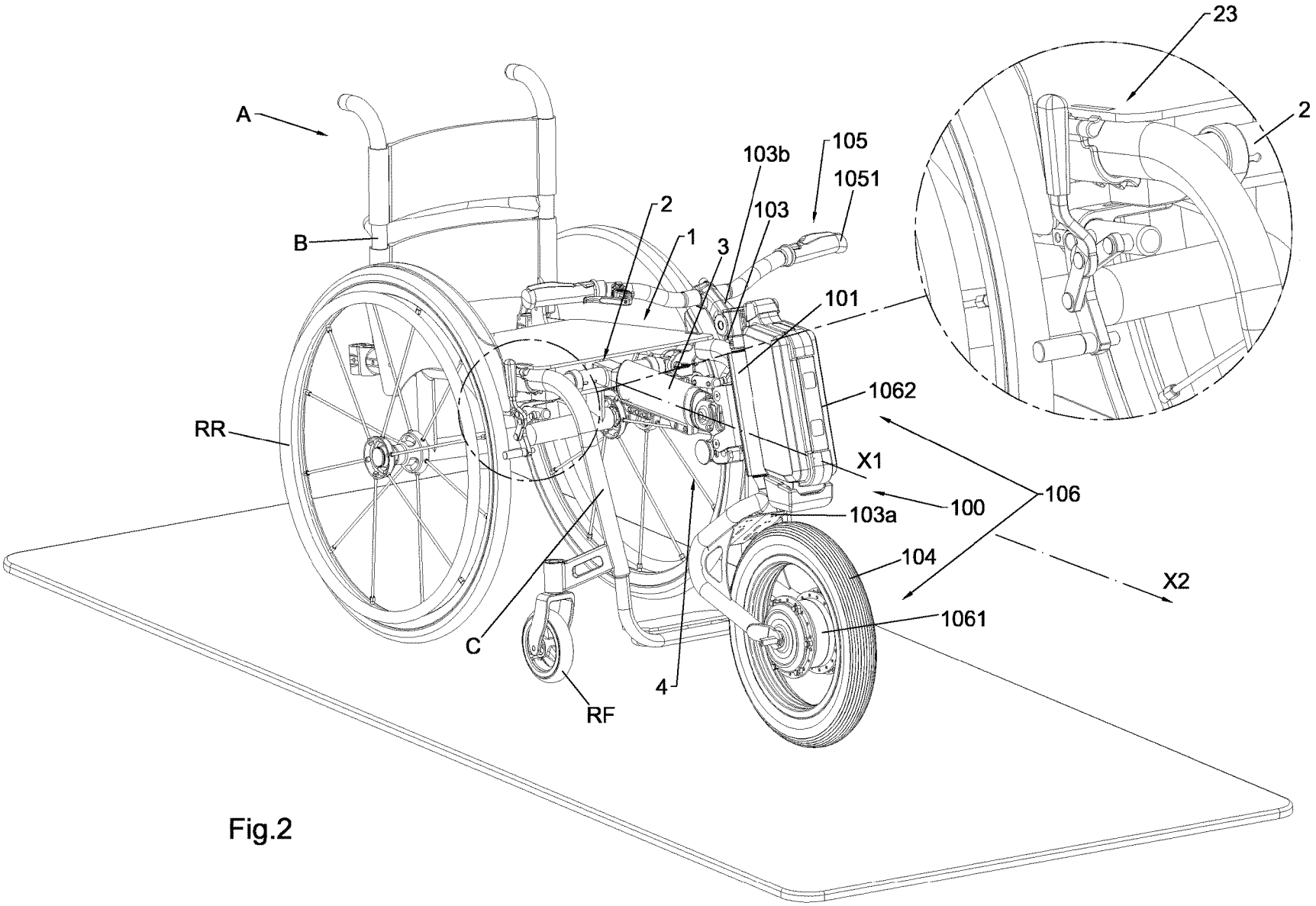
FIG. 2 shows the auxiliary drive system of the invention comprising the connection assembly in FIG. 1, coupled to a wheelchair A.

The connection assembly of the invention for coupling an auxiliary drive system to a wheelchair for disabled people is shown isolated, according to a preferred embodiment example, in FIG. 1, and in FIG. 2 applied between said wheelchair A and the auxiliary drive system 100, where it is indicated as a whole with reference numeral 1.

As can be seen in FIG. 1, the connection assembly 1 comprises a fixing structure 2 adapted to be fixed to framework B of the above wheelchair A.

In particular, preferably but not necessarily, such a fixing structure 2 comprises a crosspiece 23, at the ends of which there are provided first fixing means 24 to the lateral structural elements C of framework B of wheelchair A, as can be seen in FIG. 2. Moreover, such a crosspiece 23, in a central position, comprises second fixing means 25 to a longitudinal member 3, also belonging to the connection assembly 1 of the invention.

Even more in detail, according to the preferred embodiment of the invention described herein, such second fixing means 25 allow fixing in a reversible manner the longitudinal member 3 to the above crosspiece 23.

It is not excluded, however, that according to different embodiments of the invention, such a fixing structure 2 and the longitudinal member 3 are connected to each other in non-reversible manner or are even made as a single block.

In any case, both according to the preferred embodiment described herein and according to the alternative embodiments of the invention, the longitudinal member 3 is operatively connected to the fixing structure 2 in such a way that its longitudinal development axis X1 is substantially parallel to the advancement direction X2 of said wheelchair A when the connection assembly 1 of the invention is applied to the latter.

According to the invention, the connection assembly 1 further comprises connection means 4 associated to the free end 31 of the longitudinal member 3 and to the auxiliary drive system 100 and configured to allow the quick coupling and decoupling of said auxiliary drive system 100 to and from wheelchair A.

Advantageously, this feature allows simplifying and speeding up, even for people having a high level of motor disability, the coupling and decoupling of the drive system 100 to and from wheelchair A, with respect to the connection assemblies of the auxiliary drive systems for wheelchairs of known type.

Figure 3:
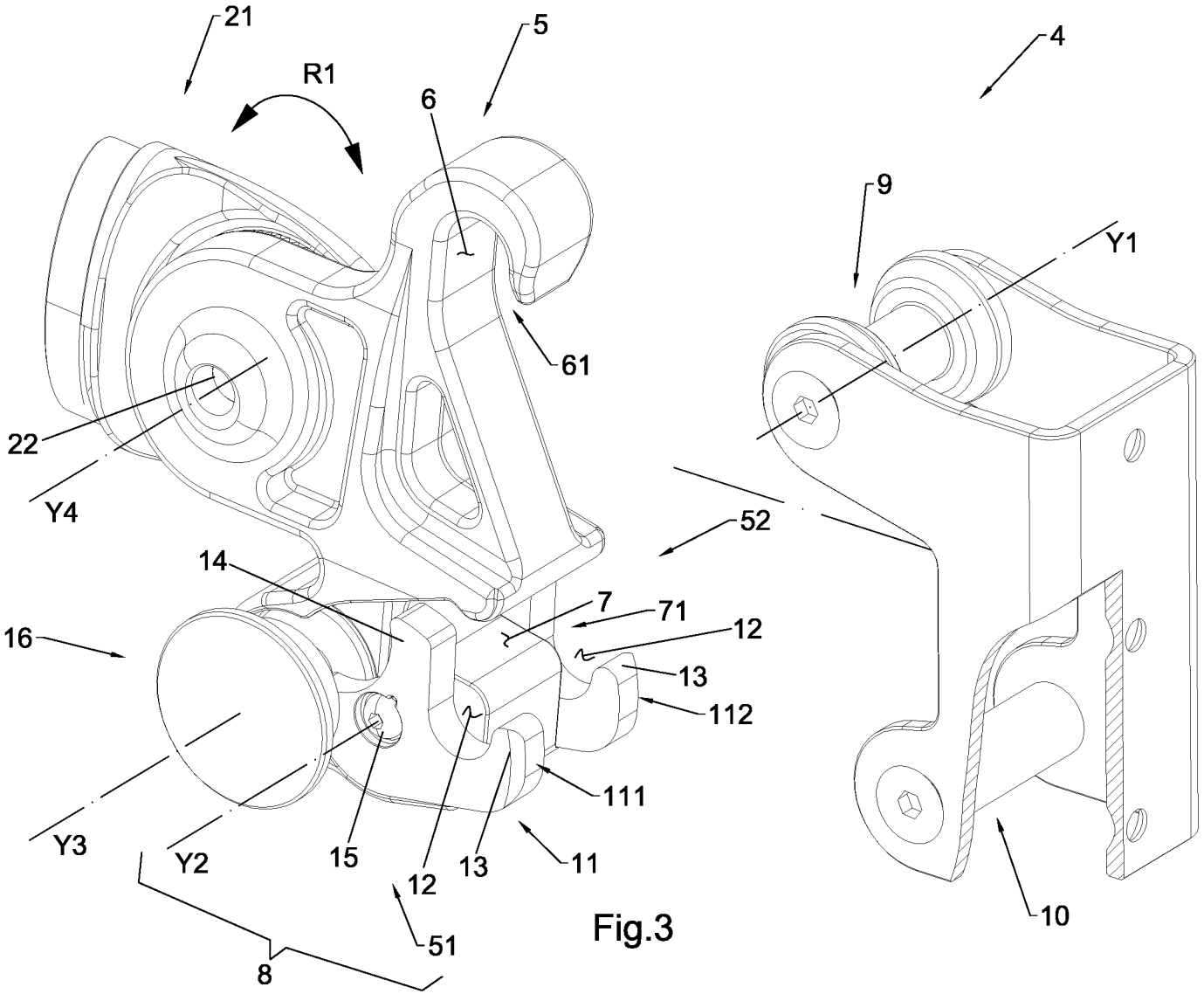
FIG. 3 shows the connection means belonging to the connection assembly of the invention in FIG. 1.

Preferably but not necessarily, the connection assembly 1 of the invention, in particular the connection means 4, as can be seen in FIG. 3, comprise a main body 5 in which a first seat 6 and a second seat 7 are identified. More particularly, each of said seats 6 and 7 is defined with a substantially "C" shaped profile and is provided with an access mouth, indicated in FIGS. 3 and 4 with 61 and 71, respectively.

As is clearly seen in FIG. 3, the access mouth 61 is substantially facing towards the ground when the connection assembly 1 is connected to wheelchair A, thus allowing access to seat 6 according to a substantially vertical direction orthogonal with respect to the advancement direction X2.

Even more in detail, it is seen in FIG. 3 that the "C" shape of the first seat 6 prevents access thereto or escape therefrom according to a direction substantially parallel to said advancement direction X2.

The usefulness of this structural feature will become apparent hereinafter during the description of the operating steps of coupling and decoupling the auxiliary drive system 100 to and from wheelchair A.

As regards the access mouth 71, it is oriented according to a direction substantially parallel to the advancement direction X2 of wheelchair A when the above connection assembly 1 is coupled to wheelchair A itself.

Moreover, according to the invention, the main body 5 comprises a locking mechanism 8 operatively associated at the second seat 7. Such a locking mechanism 8 is configured to assume, with respect to the main body 5, a first configuration, shown in FIGS. 5*a* and 5*b*, according to which access to the second seat 7 is allowed through the access mouth 71, and a second configuration, shown in FIGS. 6*a* and 6*b*, according to which such an access mouth 71 is occluded. Therefore, clearly, in this second configuration, access or escape to/from the second seat 7 through the corresponding access mouth 71 is prevented.

According to the preferred embodiment of the connection assembly 1 of the invention, it is further provided that the above connection means 4 comprise a pin 9 and a driving element 10 both with a substantially longitudinal development and mutually defined substantially parallel and integral, as can be seen in FIG. 3.

Moreover, as is clearly seen in FIGS. 11 to 14, upon fixing the drive system 100 to wheelchair A by means of the connection assembly 1 of the invention and thereafter, said pin 9 and said driving element 10 are arranged orthogonally to the advancement direction X2 of wheelchair A itself.

Figures 11, 12:
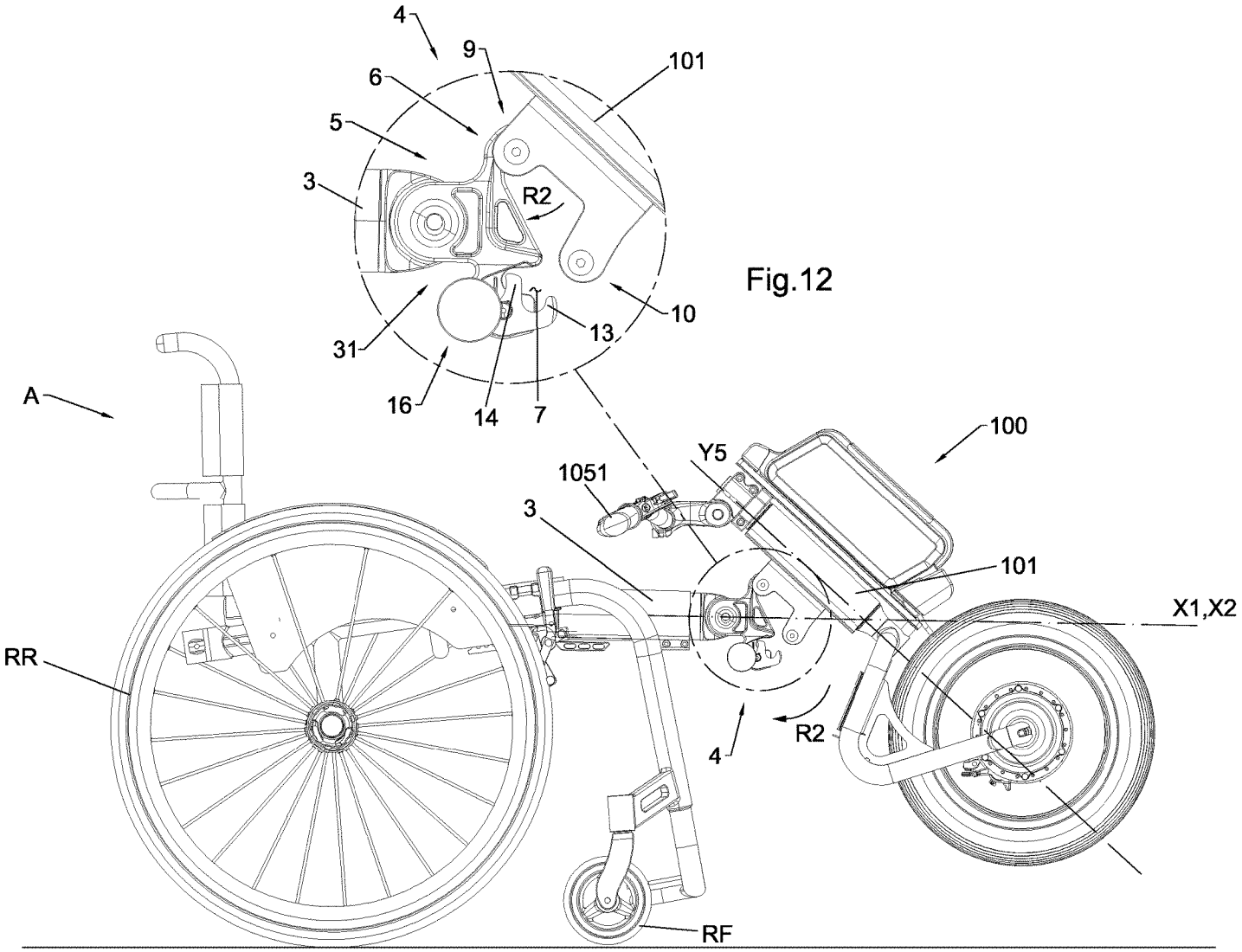
FIG. 11 shows the first operating step provided by the coupling method between a wheelchair and the auxiliary drive system of the invention.
FIG. 12 shows the detail of the connection means of the connection assembly of the invention in the first operating step of the coupling method in FIG. 11.

According to the preferred embodiment of the invention described heretofore, pin 9 is configured to be received in the first seat 6, as shown in FIG. 12 and as will be described in detail hereinafter, and the driving element 10 is configured to be inserted in the second seat 7 and to carry out, during such an insertion, the translational motion of said locking mechanism 8 from the first configuration to the second configuration just described. As will be specified hereinafter during the description of the operating steps of coupling and decoupling of the auxiliary drive system 100 to and from wheelchair A, the insertion of the driving element 10 in the second seat 7 takes place upon the insertion of pin 9 in said first seat 6 and upon the rotation of the drive system 100 with respect to wheelchair A around the axis of rotation Y1 defined by pin 9 itself.

It is not excluded, however, that different embodiments of the invention with respect to said embodiment example considered herein in detail may provide a different structure with respect to the connection means 4 described, provided it is equally able to allow the quick coupling and decoupling of the auxiliary drive system 100 to and from wheelchair A.

Returning to the preferred embodiment of the invention, as can be seen in FIGS. 1 and 2, the main body 5 with the locking mechanism 8 is associated to the free end 31 of the longitudinal member 3, while pin 9 and the driving element 10 are associated with the auxiliary drive system 100, in particular column 101 belonging to the latter.

It is not excluded, however, that according to an embodiment variant of the connection assembly 1 of the invention, the main body 5 together with the fixing mechanism 8 can be associated to column 101 of the auxiliary drive system 100, while pin 9 and the driving element 10 can be fixed on the free end 31 of said longitudinal member 3.

Moreover, the embodiment example considered herein provides, preferably but not necessarily, that during the use of the connection assembly 1 of the invention for connecting an auxiliary drive system 100 to a wheelchair A, the first seat 6 is defined, according to the vertical direction, at a greater height than the second seat 7 and consistently pin 9 is defined at a greater height than the driving element 10.

It is not excluded, however, that, according to an alternative embodiment of the invention, it may be contemplated to define the second seat 7 and the driving element 10 at a higher height than the first seat 6 and pin 9, respectively.

Going now in more detail in the embodiment example of the connection assembly 1 of the invention described herein, the locking mechanism 8 comprises, as shown in FIGS. 4 to 8, a locking element 11 which defines, in turn, a housing 12 between a first protrusion 13 and a second protrusion 14.

Figure 7:
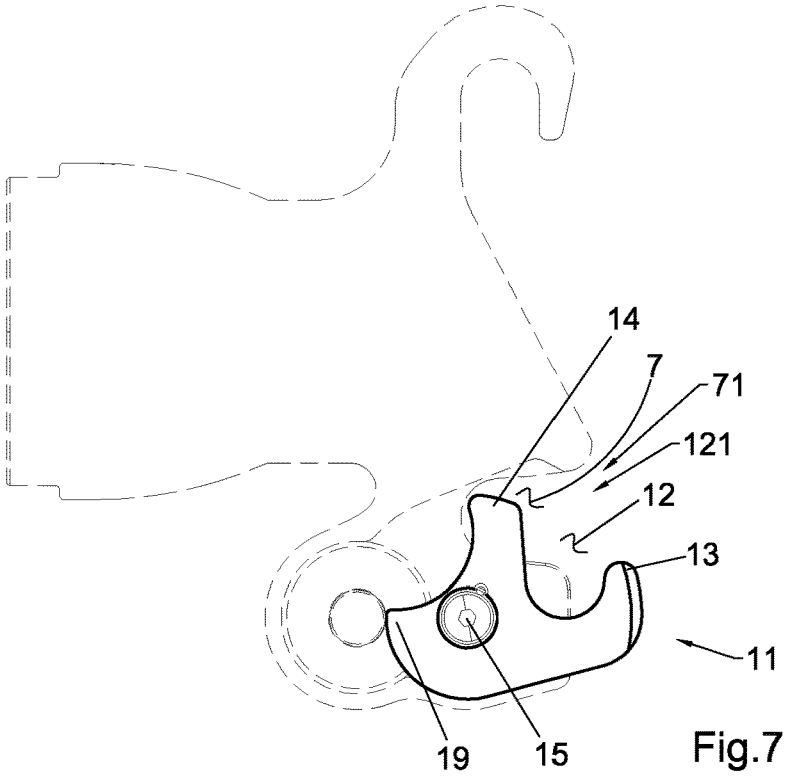
FIG. 7 shows a lateral view of the first position assumed by the locking element belonging to the locking mechanism in the above first configuration shown in FIGS. 5*a* and 5*b;*

According to this embodiment, the locking element 11 is rotatably associated to the main body 5 by means of pin means 15 having the axis of rotation Y2 substantially orthogonal to the advancement direction X2 so that the same locking element 11 can assume a first position and a second position with respect to the main body 5. In particular, the above first position of the locking element 11, represented in FIG. 7, provides for the possibility to access the second seat 7 through the access mouth 71, since access 121 of housing 12 is located at least partially superimposed on the access mouth 71 itself.

Figure 8:
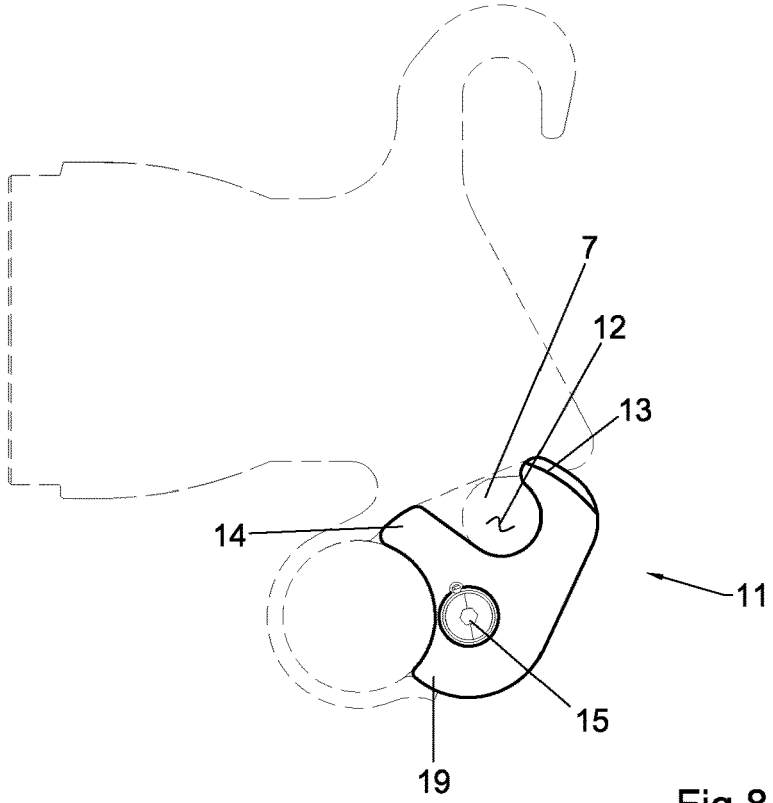
FIG. 8 shows a lateral view of the second position assumed by the locking element belonging to the locking mechanism in the above second configuration shown in FIGS. 6*a* and 6*b;*

The second position that the locking element 11 can assume with respect to the main body 5 instead provides that the first protrusion 13 is arranged so as to occlude the access mouth 71 of the second seat 7, as shown in FIG. 8.

With regard to the pin means 15, according to the preferred embodiment described herein, they comprise a pin 151 and elastic means 152 configured to force the rotation of the locking element 11 from said second position to the first position.

In particular, it is provided that these elastic means 152 comprise a torsion spring 1521 wound around said pin 151.

It is not excluded, however, that according to different embodiments of the invention these elastic means 152 are not present or comprise a different type of spring than a torsion spring 1521 or, again, that they comprise another elastic element provided it is able to perform the function described above.

As regards the locking mechanism 8, as can be seen in FIGS. 3 to 6*a* and 6*b*, it comprises a release element 16 operatively associated with the main body 5 itself and cooperating with the locking element 11.

In particular, the release member 16 is configured to assume two operating positions with respect to the main body 5. In a first position, shown in particular in FIG. 9, the release element 16 must allow the locking element 11 to switch from its first position to its second position or vice versa, while at its second position, which is seen in FIG. 10, the release element 16 must prevent the locking element 11 from switching from the second position to the first position.

The usefulness of such configurations and cooperation between the locking element 11, the release element 16 and the main body 5 will become apparent hereinafter during the description of the operating steps of coupling and decoupling the auxiliary drive system 100 to and from wheelchair A.

Figure 9:
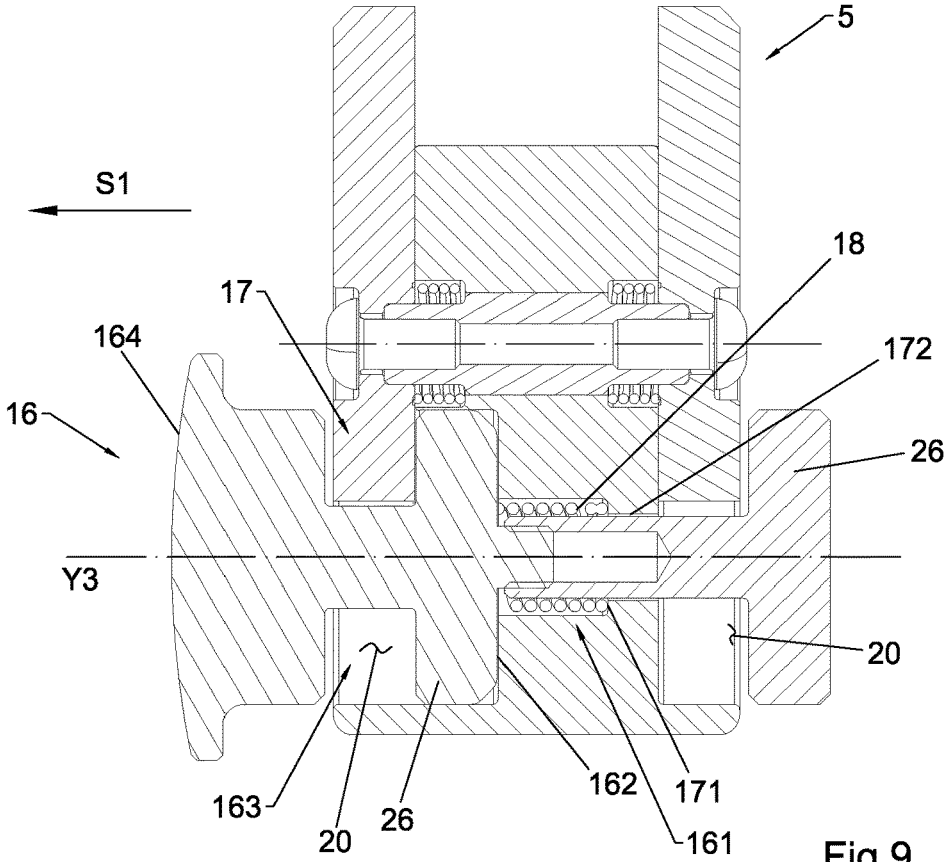
FIG. 9 shows a front sectional view of the first position assumed by the release element belonging to the locking mechanism in the above first configuration shown in FIGS. 5*a* and 5*b;*
Figure 10:
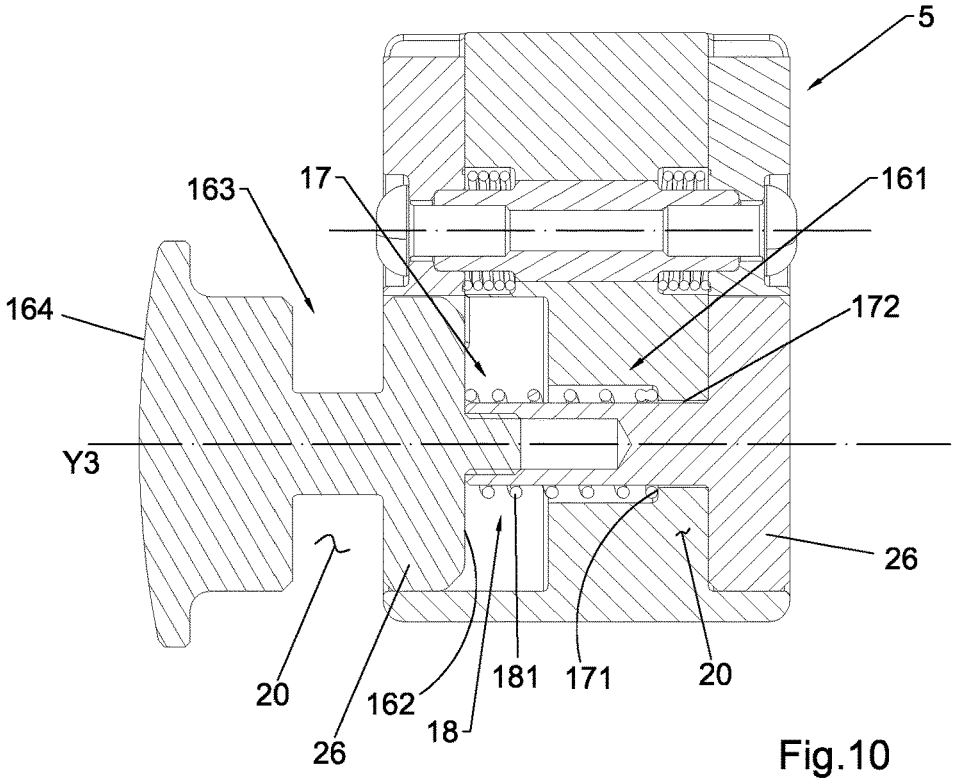
FIG. 10 shows a front sectional view of the second position assumed by the release element belonging to the locking mechanism in the above second configuration shown in FIGS. 6*a* and 6*b;*

According to the preferred embodiment of the invention, the release element 16 is configured to translate according to a translation axis Y3 substantially orthogonal to the advancement direction X2 within a housing 17 defined in the main body 5, in order to switch from said first position to the second position or vice versa, as shown in FIGS. 9 and 10, respectively.

In more detail, the release element 16 is operatively associated with said housing 17 of the main body 5 through the interposition of elastic means 18 configured to force the translation of the release element 16 itself from its first position to the second position, as indicated by arrow S1 in FIG. 9.

Preferably but not necessarily, these elastic means 18 comprise a compression spring 181 wound on a first stretch 161 with substantially longitudinal development of the release element 16 and operating between an abutment surface 162 of the release element 16 itself and bottom 171 of housing 17, as can be seen in FIG. 10.

It is not excluded, however, that according to different embodiments of the invention these elastic means 18 are not present or comprise a different type of spring than a compression spring 181 or, again, that they comprise a different elastic element provided it is able to perform the function described above.

With regard to the cooperation between the locking element 11 and the release element 16, according to the preferred embodiment, it is obtained since the locking element 11 comprises a third protrusion 19 which develops and lies on a plane substantially orthogonal to the axis of rotation Y1, as can be seen in FIGS. 7 and 8, in conjunction with the fact that the release element 16 comprises a recess 20 defined at a second stretch 163 of the release member 16 itself, according to a radial direction with respect to the axis of development of the latter.

Figure 5A:
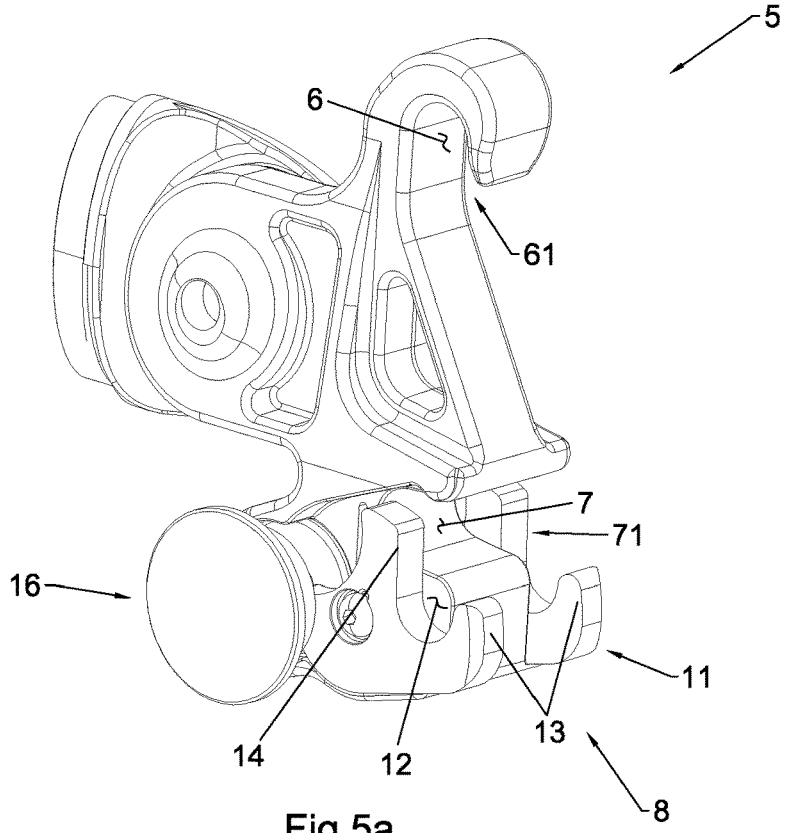
FIGS. 5*a* and 5*b* show a lateral view and an isometric view of the main body and the locking mechanism in a first mutual configuration.
Figure 5B:
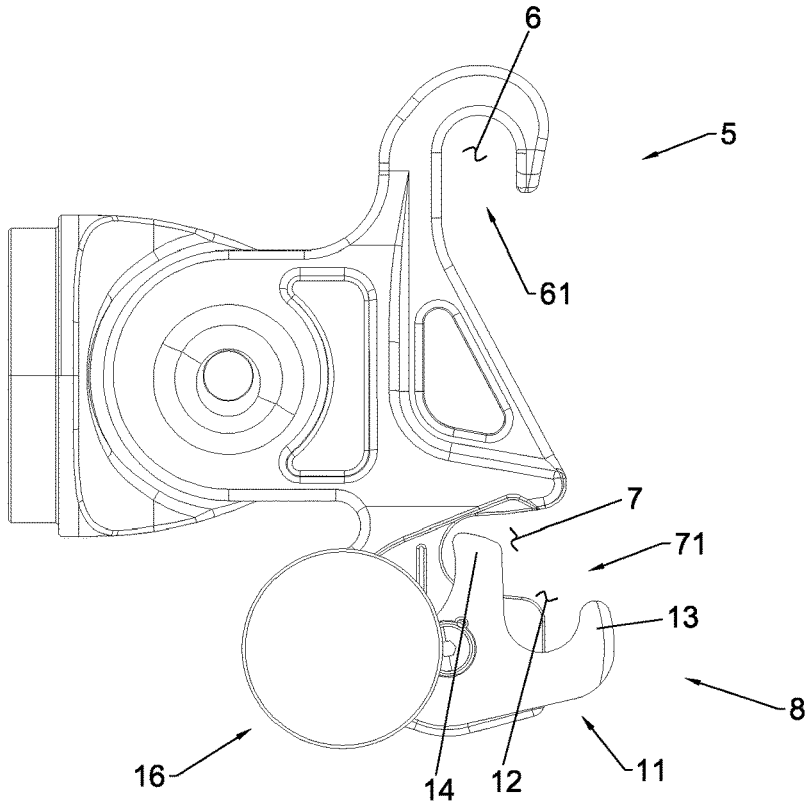

Such a recess 20 is configured to accommodate said third protrusion 19 when both the release member 16 and the locking element 11 are arranged at the corresponding first positions, as shown in FIGS. 5*a* and 5*b*.

Such a configuration therefore allows, as mentioned above, the translation of the release element 16 from its first position to its second position to be prevented.

With regard to the second stretch 163 of the release element 16, as can be seen in FIG. 9, it is defined in a position opposite to the first stretch 161 with respect to the abutment surface 162, as will be described in detail hereinafter for the specific embodiment shown in the figures.

Figure 6A:
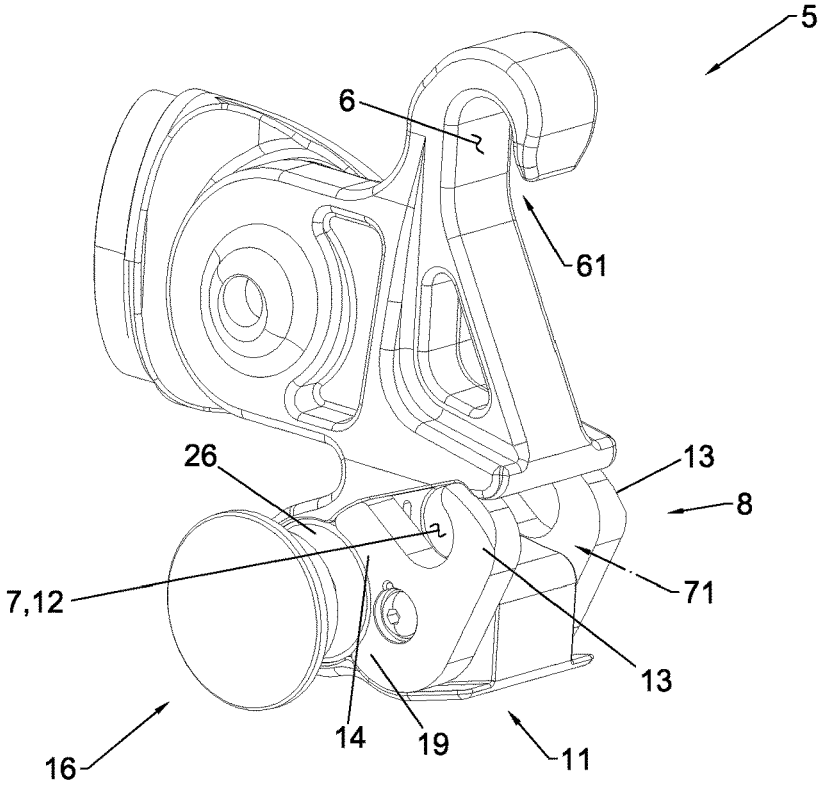
FIGS. 6*a* and 6*b* show a lateral view and an isometric view of the main body and the locking mechanism in a second mutual configuration.
Figure 6B:
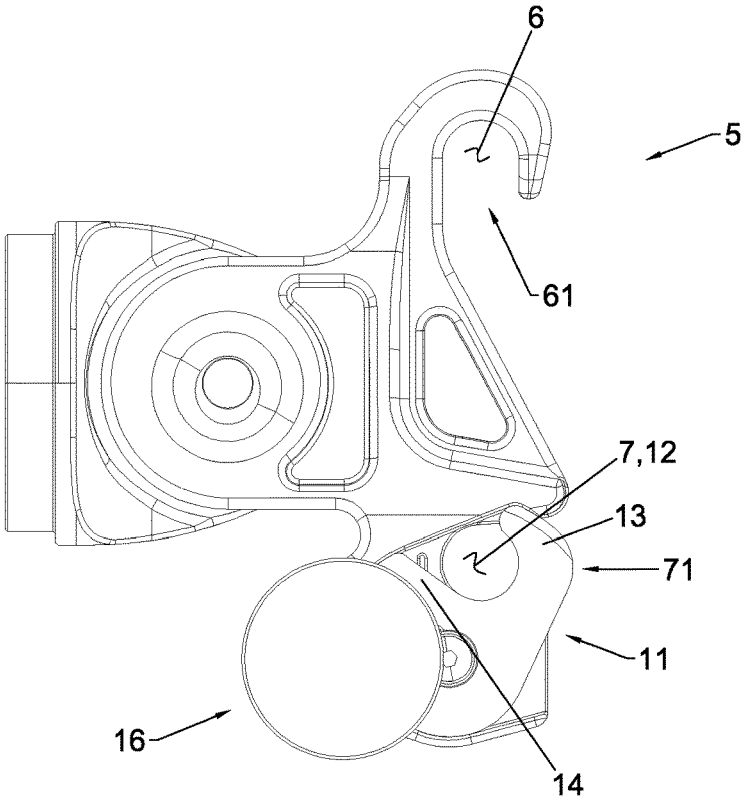

Moreover, the above cooperation is also obtained since the release element 16 is configured to act as a stop member for the third protrusion 19, when both the release element 16 and the locking element 11 are arranged at the corresponding second positions thereof, as can be seen in FIGS. 6*a* and 6*b*. In particular, the release element 16 has a stop member 26 sized in such a way as to oppose the third protrusion 19 and, consequently, prevent the rotation of the locking element 11 around the axis of rotation Y2 of the above pin means 15 from the second position to the first position.

The usefulness of such a configuration will be clarified hereinafter, in the description of the coupling and decoupling steps of the connection assembly 1 of the invention between an auxiliary drive system 100 and a wheelchair for the disabled A.

It is not excluded, however, that according to alternative embodiments of the invention, the release element 16 may be structurally defined and operatively configured to be connected with the main body 5 and cooperate with the locking element 11 in a different way from the preferred embodiment example described thus far, provided that the release element 16 itself is able to carry out the above functions in the two relative positions.

Figure 4:
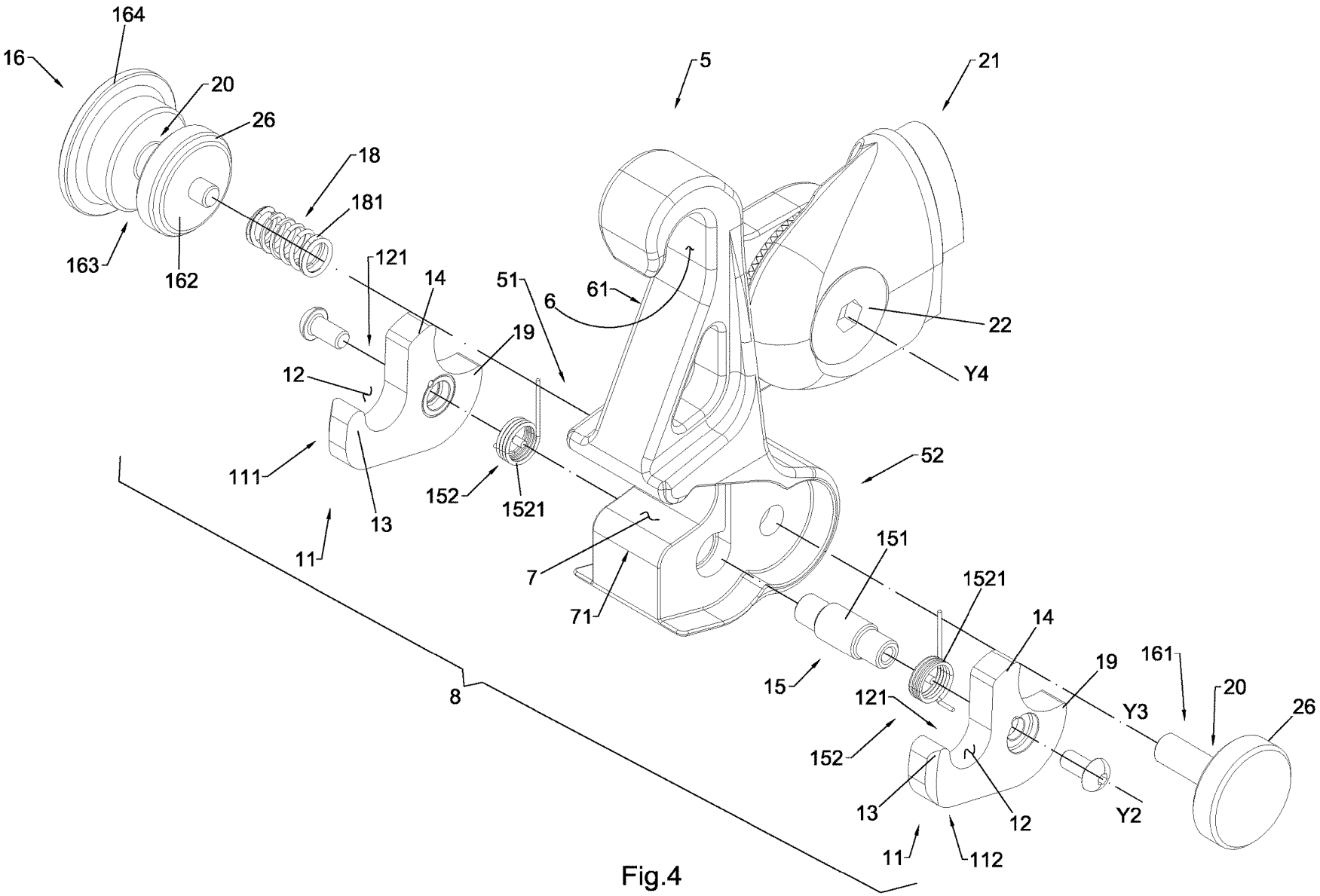
FIG. 4 shows an exploded isometric view of the main body and the locking mechanism of the connection means in FIG. 3.

Moreover, returning to the preferred embodiment example considered of the connection assembly 1 of the invention, the locking element 11 comprises, as shown in FIGS. 3 and 4, two separate plate-like elements 111 and 112 having substantially the same shape and size, arranged at the opposite sides 51 and 52 of the main body 5 and operatively connected to each other and to the main body 5 itself by means of the pin means 15. In particular, such two plate-like elements 111 and 112 are integrally connected to each other by means of the above pin means 15 and they are configured to rotate together with respect to the main body 5 from said first position to said second position or vice versa.

Likewise, according to the preferred embodiment of the invention, the release element 16, as can be seen in FIGS. 9 and 10, comprises two recesses 20 in such a way that each of them is able to accommodate a respective third protrusion 19, belonging to each of the plate-like elements 111 and 112, when both the locking element 11 and the release element 16 are located in the respective first positions.

Moreover, preferably but not necessarily, the release element is configured to act as a stop towards the third protrusion 19 of both the above plate-like elements 111 and 112 when the release element 16 and the locking element 11 are arranged at the corresponding second positions, as can be seen in FIGS. 6*a* and 6*b*.

In order to obtain this last function, as explained above, the release element 16 must have two stop members 26 shaped in such a way as to counteract both third protrusions 19 of the plate-like elements 111 and 112 and thus prevent the rotation around said pin means 15 of the latter from the second position to the first position.

In more detail, considering the cross-sectional view of the release element 16 in FIG. 9 in the direction from left to right, it is provided in a sequence with a first recess 20, a first stop member 26 on which the above abutment surface 162 is defined, the first stretch 161, on which the compression spring 181 is wound, the second recess 20, which corresponds to the final part of said first stretch 161, and finally the second stop member 26.

As is clear from the above FIGS. 9 and 10, in order to allow the insertion and the translation of the release element 16 within housing 17, at bottom 171 of the latter it is necessary to define a through hole 172 through which said first stretch 161 is slidably coupled.

It is not excluded, however, that according to an alternative embodiment of the invention, the release element 16 may be configured to act as a stop member for the third protrusion 19 of only one of the two plate-like elements 111 and 112 since, the latter being integrally connected to each other by means of the pin means 15, the fact of preventing the rotation of one of them jointly prevents the rotation of the other as well.

Finally, according to the preferred embodiment of the invention discussed herein, the release element 16 has the free end 164 thereof accessible from the outside and configured in such a way as to be intercepted by a person, in order to be able to exercise a thrust on the release element 16 itself in the opposite direction with respect to the thrust exerted by the elastic means 18. The usefulness of this feature will be clarified shortly. In particular, as shown in FIGS. 9 and 10, the free end 164 is shaped as a button.

The connection assembly 1, according to the preferred embodiment of the invention, also provides that the connection means 4 comprise a hooking element 21 for fixing to the free end 31 of the longitudinal member 3, operatively connected to the main body 5 by means of pin means 22. In particular, these pin means 22 define an axis of rotation Y4 substantially orthogonal to the advancement direction X2 of wheelchair A so as to be able to vary the inclination of the auxiliary drive system 100 with respect to wheelchair A itself, as indicated by arrow R1 in FIG. 3.

As mentioned above, the invention also relates to the auxiliary drive system 100 for wheelchairs for the disabled A which comprises, as can be seen in FIG. 2, a tubular column 101 and a steering assembly 102 in turn comprising a steering tube 103 rotatably inserted in the tubular column 101. Such a steering tube 103 is associated at a first end 103*a* to a wheel 104 and at the second end 103*b* to steering means 105. Preferably, such steering means 105 comprise a handlebar 1051.

Moreover, the auxiliary drive system 100 comprises motion generating means 106, preferably an electric motor 1061 with relative battery pack 1062, associated with wheel 104 to carry out the rotation thereof.

It is not excluded that, according to different embodiments of the auxiliary drive system 100 of the invention, such motion generating means 106 may be manual.

According to the invention, the auxiliary drive system 100 comprises a connection assembly to a wheelchair A having the features described above for the connection assembly 1 according to the preferred embodiment of the invention, including the possible embodiment variants described or, if not described, still belonging to the prior art.

From the operational point of view, the first installation of the auxiliary drive system 100 of the invention, comprising the connection assembly 1, on a wheelchair A provides for fixing and suitably adjusting crosspiece 23 of the fixing structure 2 to the lateral structural elements C of framework B of wheelchair A by means of the above first fixing means 24.

Once this operation has been carried out, crosspiece 23 is maintained stably associated to the above wheelchair A, unless one wants to use the auxiliary drive system 100 on a different wheelchair.

The installation operation then provides to hook the longitudinal member 3 to crosspiece 23 by means of said second fixing means 25.

Figure 16:
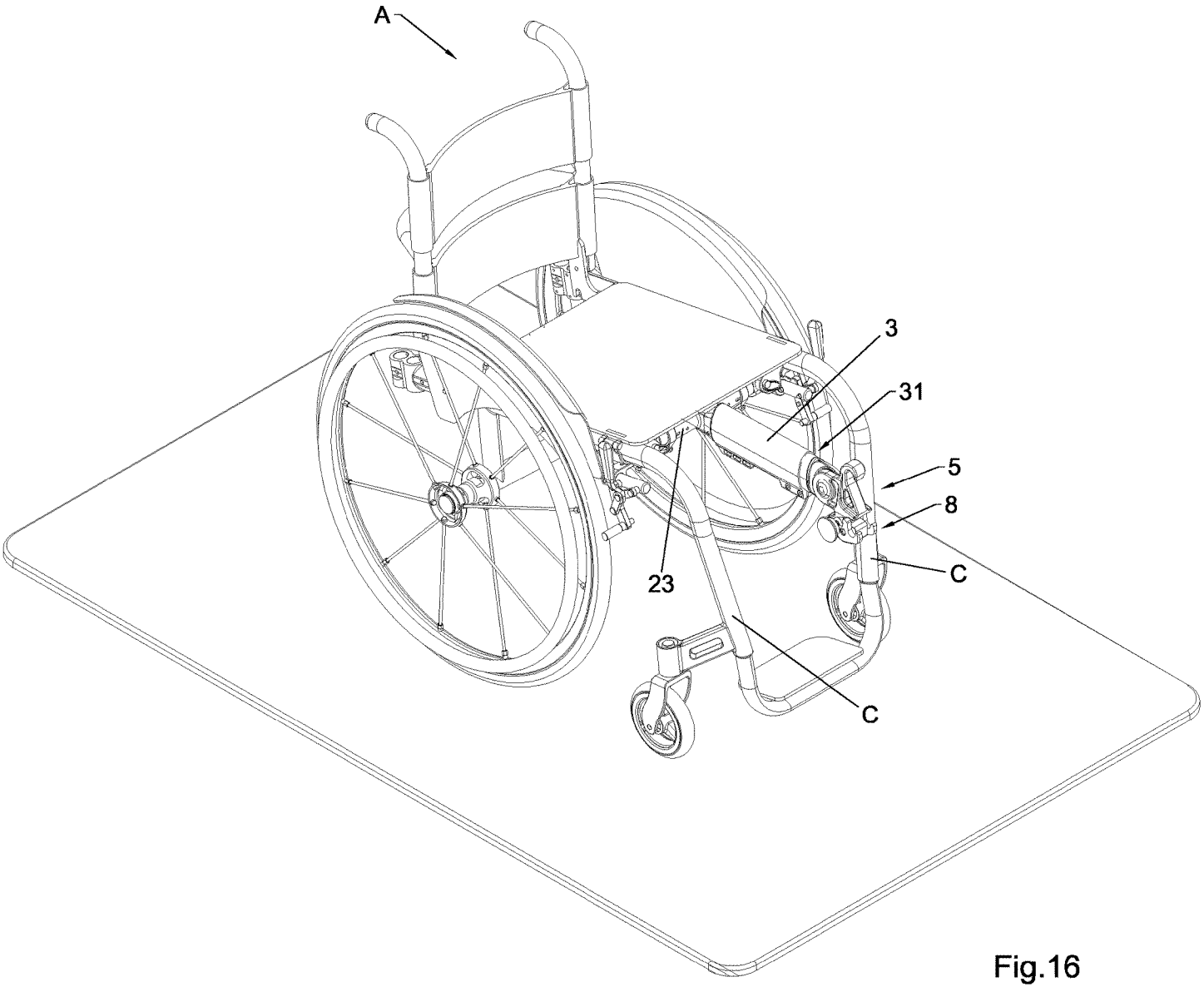
FIG. 16 shows the preliminary installation configuration of the connection assembly of the invention for coupling an auxiliary drive system to a wheelchair.

Since such a longitudinal member 3, according to the preferred embodiment of the invention, can be associated in a reversible manner to crosspiece 23, the user can choose to leave the longitudinal member 3 itself mounted to wheelchair A also when the auxiliary drive system 100 is not used, as can be seen in FIG. 16, or he/she may decide to couple and decouple it whenever he/she wants to use or not said auxiliary drive system 100.

At this point, during the connection step of the auxiliary drive system 100, wheelchair A is provided with crosspiece 23 and the longitudinal member 3 which, in turn, is provided at end 31 thereof with the main body 5 and the locking mechanism 8 belonging to the connection means 4, as can be seen in FIG. 16.

In particular, the main body 5 and the locking mechanism 8 are in a rest configuration corresponding to said first configuration described above. In more detail, as it can be seen in the detail in FIGS. 5*a* and 5*b*, this rest configuration provides that both the locking element 11 and the release element 16 are in the respective first positions.

It should be noted that this rest configuration is stable as long as there is no outside intervention, as the elastic means 152 belonging to the pin means 15 force the locking element 11 to maintain the above first position.

It should also be noted that at the above-mentioned first configuration of the locking mechanism 8, the two third protrusions 19 of the locking element 11, in particular of the two plate-like elements 111 and 112, are inserted into recesses 20 of the release element 16. In this way, therefore, the translation of the release element 16 from its first position to the second position is prevented.

In order to proceed to the coupling between the auxiliary drive system 100, provided with pin 9 and the driving element 10, to wheelchair A, the connection assembly 1 of the invention provides for inserting said pin 9 in the first seat 6 through the access mouth maintaining the same auxiliary drive system 100 inclined with respect to the advancement direction X2 by an angle greater than or equal to 90°, preferably in the range of between 90° and 130°, between the same advancement direction X2 and the development axis Y5 of the tubular column 101, as shown in FIG. 11 and in the detail in FIG. 12.

This first operation, therefore, advantageously, does not require having to modify in any way the position of wheelchair A. It does not require, therefore, any extra effort by the user of wheelchair A except that required to precisely insert pin 9 into seat 6 maintaining the auxiliary drive system 100 inclined with respect to the same wheelchair A.

The next operation necessary for the connection of the auxiliary drive system 100 to wheelchair A provides to rotate the same auxiliary drive system 100 towards wheelchair A around the axis of rotation Y1 defined by said pin 9, as indicated by arrow R2 still in FIGS. 11 and 12.

Figures 14, 15:
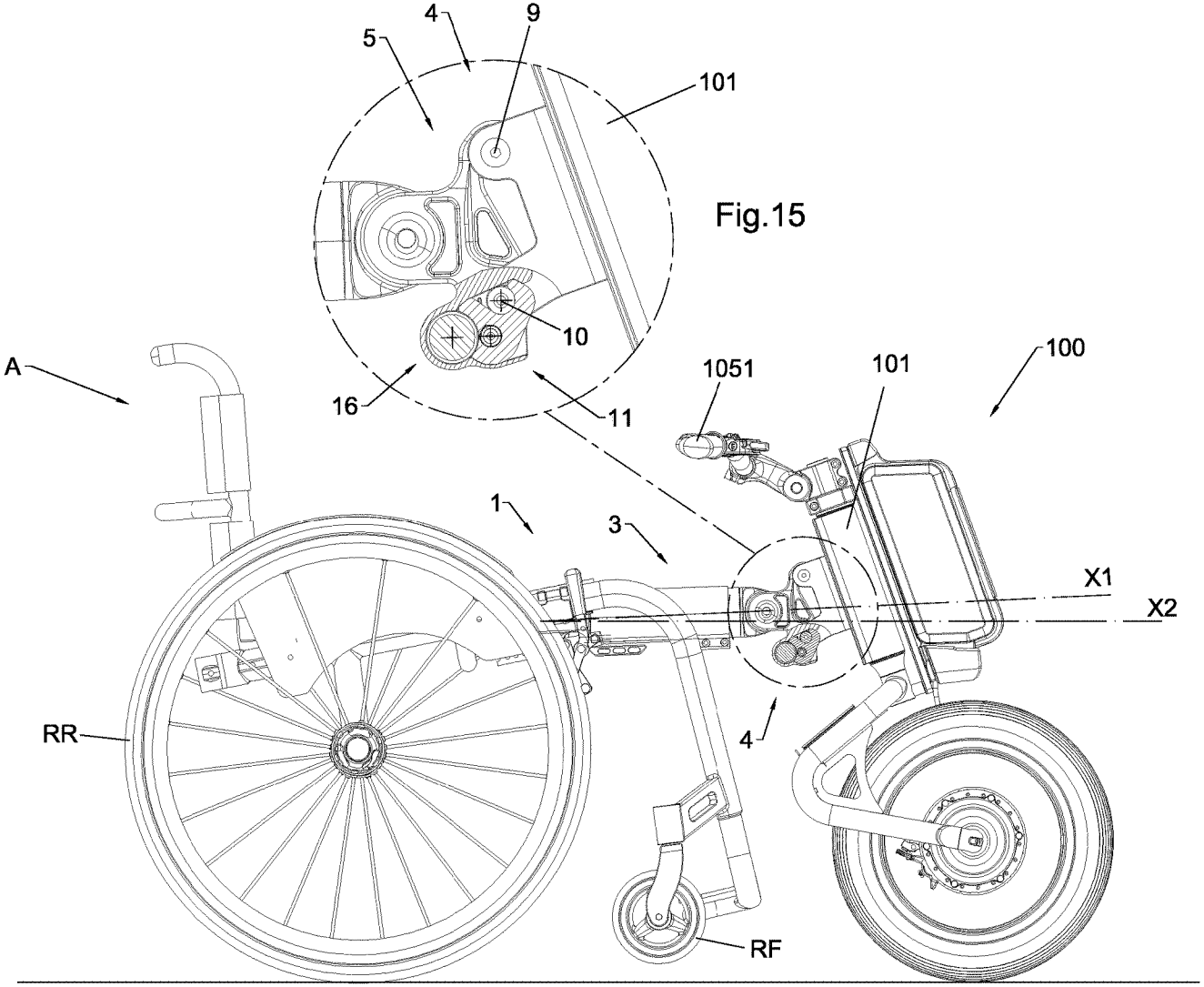
FIG. 14 shows the second operating step provided by the coupling method between a wheelchair and the auxiliary drive system of the invention.
FIG. 15 shows the detail of the connection means of the connection assembly of the invention in the second operating step of the coupling method in FIG. 14.

This operation has two purposes: the first is precisely to allow the coupling of the auxiliary drive system 100 to wheelchair A, the second consists in raising the wheelchair at the front in such a way that the front wheels RF of the same wheelchair A do not touch the ground, as shown in FIG. 14.

With regard to the rotary movement, it can be carried out by the disabled user, clearly seated in wheelchair A, keeping the rear wheels RR of the same wheelchair A blocked and pushing handlebar 1051 of the auxiliary drive system 100 forward, so as to facilitate the rotation of the auxiliary drive system 100 itself around axis Y1, in the direction indicated with R2.

Alternatively, the disabled user may hold the auxiliary drive system 100 and push wheelchair A forward, obtaining the same effect.

In any case, as described above, the specific shape of the first seat 6 and of the relative access mouth 61 prevents the accidental escape of pin 9 from the first seat 6 itself when this operation is carried out.

Figure 13:
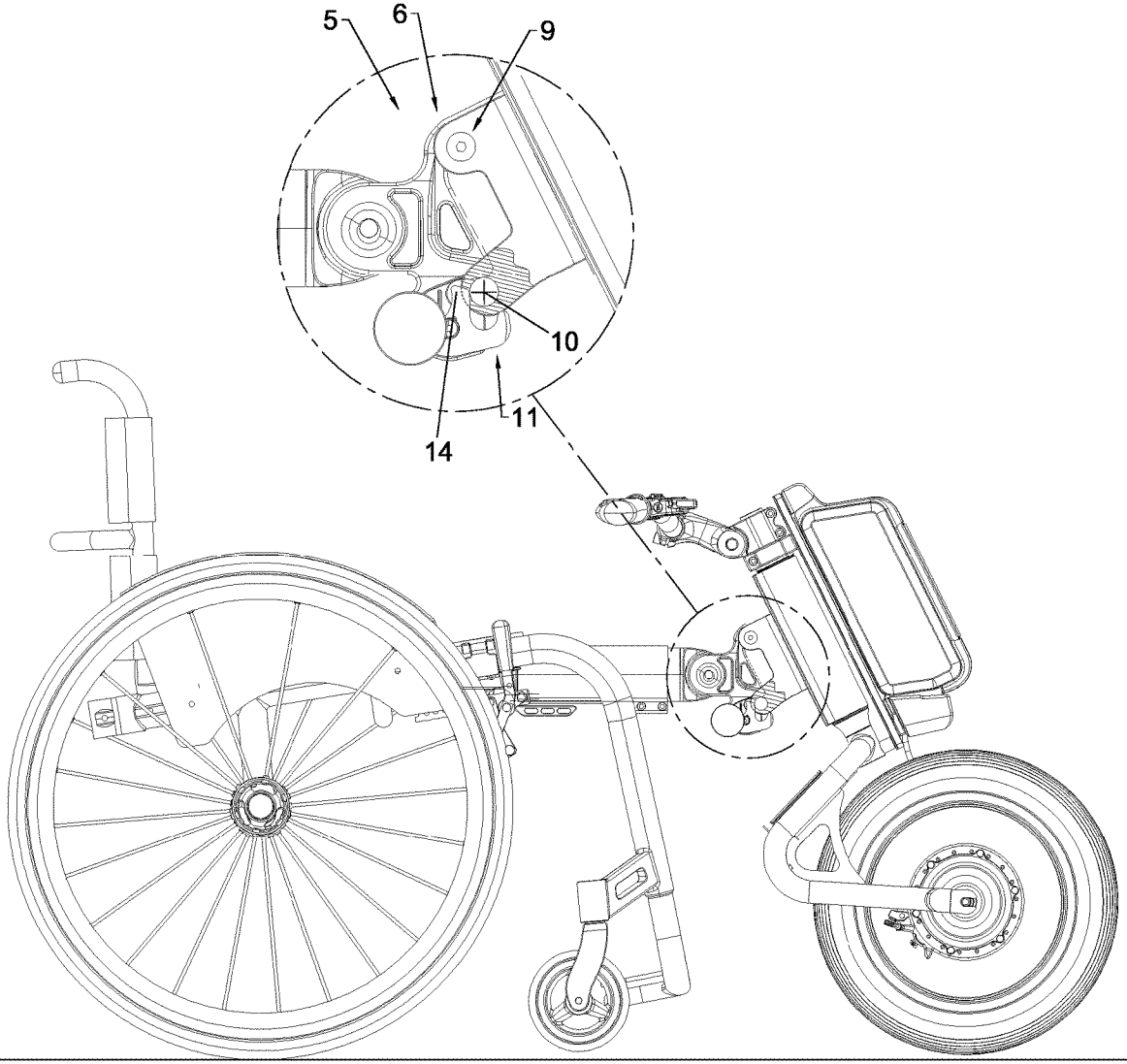
FIG. 13 shows the detail of the connection means of the connection assembly of the invention in the transition between the first operating step and the second operating step of the coupling method of the auxiliary drive system of the invention.

Proceeding then with the rotation of the auxiliary drive system 100, at a certain angle of inclination of the same system with respect to wheelchair A, the driving element 10 accesses the second seat 7 since the locking element 11 is in the relative first position, and comes into contact with the second protrusion 14 of the locking element 11 itself, as shown in FIG. 13.

By further advancing with this movement, the driving element 10, exerting a thrust greater than the thrust in the opposite direction exerted by the elastic means 152, causes the movement of said locking element 11 from the first position towards the second position thereof.

This movement of the locking element 11 therefore causes the protrusion of the third protrusions 19 from the respective recesses 20 of the release element 16.

Therefore, once such third protrusions 19 are completely outside such recesses 20, the release element 16 is no longer hindered in its translation, and since the above compression spring 181 is provided, it forces the release element 16 itself to switch from the above first position thereof to the second position thereof, as shown in FIG. 9.

The second configuration of the locking mechanism 8 described above and shown in FIGS. 6*a* and 6*b* is thus reached, whereby the locking element 11 is prevented from returning from the second position thereof to the first position thereof.

More in detail, the rotation of the locking element 11 is prevented by the presence of the stop members 26 defined in the release element 16, which contrast with the above third protrusion 19.

As a result, the driving element 10 is blocked inside the second seat 7 since the first protrusion 13 of the locking element 11 obstructs the access mouth 71.

Once this condition has been reached, the auxiliary drive system 100 is fixedly coupled with wheelchair A through the connection assembly 1 of the invention, as shown in FIG. 14 and in detail in FIG. 15. In particular, it should be noted that, advantageously, such connection operation is performed quickly and easily.

In order to decouple the auxiliary drive system 100 from wheelchair A, starting from the latter configuration, the disabled user must exert a thrust on the above free end 164 of the release element 16 in such a way as to overcome the counterforce exerted by the compression spring 181. In this way the release element 16 is translated back from the second position thereof to the first position thereof.

Consequently, when recesses 20 of the release element 16 return back in alignment with the third protrusions 19 of the locking element 11, thus ending the stop function carried out by the same release element 16, the locking element 11, subjected to the thrust of the elastic means 152 thereof, is translated from the second position thereof to the first position thereof.

At this point, the translation movement of the release element 16 is prevented by the presence of the third protrusions 19 within recesses 20, thereby returning to the above first operating configuration described for the locking mechanism 8.

This involves, as widely described above, the possibility to extract the driving element from the second seat 7 after rotating the auxiliary drive system 100 around pin 9 in the opposite direction with respect to the position of wheelchair A. Thereafter, then, the auxiliary drive system 100, being again inclined with respect to wheelchair A, as shown in FIG. 11, allows easily extracting pin 9 from the first seat 6, thus obtaining full decoupling of the auxiliary drive system 100 itself and wheelchair A.

It is therefore clear that the configuration of the connection assembly 1 of the invention as described above allows carrying out also the decoupling of the auxiliary drive system 100 and wheelchair A quickly and easily.

In particular, the disabled users is facilitated in the decoupling of these two elements as he/she must only exert a thrust on the free end 164 of the release element 16 in the opposite direction with respect to the thrust exerted by the compression spring 181. In other words, the disabled user does not have to carry out complex motor operations, which in many cases would be difficult if not impossible for many users with mobility problems also to the upper limbs.

Based on the above, therefore, the connection assembly 1 of the invention and the auxiliary drive system 100 of the invention achieve all the intended objects.

In particular, the object of providing a connection assembly for coupling an auxiliary drive system to a wheelchair which allows carrying out the coupling and decoupling operations quickly and easily for a disabled person, whatever his/her motor problem, is achieved.

The object of implementing a connection assembly that allows achieving a robust and stable coupling between the auxiliary drive system and the wheelchair is also achieved.

The invention claimed is:

1. A connection assembly for coupling an auxiliary drive system to a wheelchair for disabled people comprising:

a fixing structure adapted to be fixed to a framework of said wheelchair;

at least one longitudinal member operatively connected to said fixing structure at a fixing end so that a longitudinal development axis of said at least one longitudinal member is adapted to be substantially parallel to an advancement direction of said wheelchair when coupled to said wheelchair, the at least one longitudinal member comprising a free end distal from the fixing end;

connection means associated with the free end of said at least one longitudinal member and said auxiliary drive system, said connection means being configured to allow rapid coupling and decoupling of said auxiliary drive system to/from said wheelchair;

wherein said connection means comprise:

a main body in which a first seat and a second seat are defined, each of said seats being defined with a substantially "C" shaped profile and being provided with an access mouth, said main body comprising a locking mechanism operatively associated at said second seat and configured to assume with respect to said main body a first configuration according to which access to said second seat is allowed through said access mouth of said second seat and a second configuration according to which said access mouth of said second seat is occluded;

a pin and a driving element both having a substantially longitudinal development, defined substantially mutually parallel and integral, said pin being configured to be received in said first seat and said driving element being configured to be inserted into said second seat and to carry out translational motion of said locking mechanism from said first configuration to said second configuration upon insertion of said pin in said first seat and upon rotation of said auxiliary drive system with respect to said wheelchair around an axis of rotation defined by said pin;

said main body with said locking mechanism being configured to be connected to said free end of said at least one longitudinal member and said pin and said driving element being configured to be connected to said auxiliary drive system or vice versa;

wherein said fixing structure comprises a crosspiece comprising:

a first end and a second end, each of said first end and second end of the crosspiece defining an opening for coupling to structural elements of said wheelchair; and a central portion coupled to said fixing end of said at least one longitudinal member.

2. The connection assembly according to claim 1, wherein said locking mechanism comprises:

a locking element which defines a housing between a first protrusion and a second protrusion, said locking element being rotatably associated with said main body by pin means having the axis of rotation substantially orthogonal to said advancement direction so that said locking element can assume a first position with respect to said main body whereby access to said second seat is allowed through said access mouth of said second seat and a second position whereby said first protrusion occludes said access mouth of said second seat;

a release element operatively associated with said main body and cooperating with said locking element in such a way that said release element can assume a first position thereof with respect to said main body that allows said locking element to switch from said first position to said second position or vice versa, and in such a way that said release element can assume a second position thereof which prevents said locking element from switching from said second position to said first position.

3. The connection assembly according to claim 2, wherein the pin means comprise a second pin and elastic means configured to force the rotation of said locking element from said second position to said first position.

4. The connection assembly according to claim 3, wherein the elastic means comprise a torsion spring wound on said second pin.

5. The connection assembly according to claim 2, wherein the release element is configured to translate along a translation axis substantially orthogonal to said advancement direction within a housing defined in said main body so as to be able to switch from said first position to said second position or vice versa.

6. The connection assembly according to claim 5, wherein the release element is operatively associated with said housing of said main body through interposition of elastic means configured to force the translation of said release element from said first position to said second position.

7. The connection assembly according to claim 6, wherein the elastic means comprise a compression spring wound on a first stretch of said release element and operating between an abutment surface of said release element and a bottom of said housing.

8. The connection assembly according to claim 7, wherein:

said locking element comprises a third protrusion lying on a plane substantially orthogonal to the axis of rotation of said pin means;

said release element comprises a recess defined at a second stretch thereof, opposite to said first stretch with respect to said abutment surface, said recess being configured to accommodate said third protrusion of said locking element when both said release element and said locking element are arranged at the corresponding first positions so as to prevent the translation of said release element from said first position to said second position, said release element being further configured to act as a stop member for said third protrusion when both said release element and said locking element are arranged at the corresponding second positions, so as to prevent the translation of said locking element from said second position to said first position.

9. The connection assembly according to claim 1, wherein said main body comprises a hooking element for fixing to said free end of said at least one longitudinal member or said auxiliary drive system, said hooking element being operatively connected to said main body by a second pin means which define an axis of rotation substantially orthogonal to said advancement direction of said wheelchair so as to be able to vary an inclination of said auxiliary drive system with respect to said wheelchair.

10. An auxiliary drive system for wheelchairs for disabled people comprising:

a tubular column;

a steering assembly comprising a steering tube rotatably inserted into said tubular column and associated at a first end to a wheel and at a second end to steering means;

motion generating means associated with said wheel to operate rotation of said wheel;

the connection assembly according to claim 1 for coupling said auxiliary drive system to said wheelchairs.

11. The connection assembly according to claim 1, wherein said first seat is defined, according to a vertical direction, at a greater height than said second seat and the pin is defined at a greater height than the driving element, such that said access mouth of said first seat is substantially facing towards ground when said connection assembly is connected to said wheelchair, thus allowing access to said first seat according to a substantially vertical direction orthogonal with respect to the advancement direction, further such that said access mouth of said second seat is oriented according to a direction substantially parallel to the advancement direction of said wheelchair when said connection assembly is coupled to said wheelchair.

12. A connection assembly for coupling an auxiliary drive system to a wheelchair for disabled people comprising:

a fixing structure adapted to be fixed to a framework of said wheelchair;

at least one longitudinal member operatively connected to said fixing structure at a fixing end so that a longitudinal development axis of said at least one longitudinal member is adapted to be substantially parallel to an advancement direction of said wheelchair when coupled to said wheelchair, the at least one longitudinal member comprising a free end distal from the fixing end;

connection means associated with the free end of said at least one longitudinal member and said auxiliary drive system, said connection means being configured to allow rapid coupling and decoupling of said auxiliary drive system to/from said wheelchair;

wherein said connection means comprise:

a main body in which a first seat and a second seat are defined, each of said seats being defined with a substantially "C" shaped profile and being provided with an access mouth, said main body comprising a locking mechanism operatively associated at said second seat and configured to assume with respect to said main body a first configuration according to which access to said second seat is allowed through said access mouth of said second seat and a second configuration according to which said access mouth of said second seat is occluded;

a pin and a driving element both having a substantially longitudinal development, defined substantially mutually parallel and integral, said pin being configured to be received in said first seat and said driving element being configured to be inserted into said second seat and to carry out translational motion of said locking mechanism from said first configuration to said second configuration upon insertion of said pin in said first seat and upon rotation of said auxiliary drive system with respect to said wheelchair around an axis of rotation defined by said pin;

said main body with said locking mechanism being configured to be connected to said free end of said at least one longitudinal member and said pin and said driving element being configured to be connected to said auxiliary drive system or vice versa;

wherein said main body comprises a hooking element for fixing to said free end of said at least one longitudinal member or said auxiliary drive system, said hooking element being operatively connected to said main body by a second pin means which define an axis of rotation substantially orthogonal to said advancement direction of said wheelchair so as to be able to vary an inclination of said auxiliary drive system with respect to said wheelchair.

13. A connection assembly for coupling an auxiliary drive system to a wheelchair for disabled people comprising:

a fixing structure adapted to be fixed to a framework of said wheelchair;

at least one longitudinal member operatively connected to said fixing structure at a fixing end so that a longitudinal development axis of said at least one longitudinal member is adapted to be substantially parallel to an advancement direction of said wheelchair when coupled to said wheelchair, the at least one longitudinal member comprising a free end distal from the fixing end;

connection means associated with the free end of said at least one longitudinal member and said auxiliary drive system, said connection means being configured to allow rapid coupling and decoupling of said auxiliary drive system to/from said wheelchair;

wherein said connection means comprise:

a main body in which a first seat and a second seat are defined, each of said seats being defined with a substantially "C" shaped profile and being provided with an access mouth, said main body comprising a locking mechanism operatively associated at said second seat and configured to assume with respect to said main body a first configuration according to which access to said second seat is allowed through said access mouth of said second seat and a second configuration according to which said access mouth of said second seat is occluded;

a pin and a driving element both having a substantially longitudinal development, defined substantially mutually parallel and integral, said pin being configured to be received in said first seat and said driving element being configured to be inserted into said second seat and to carry out translational motion of said locking mechanism from said first configuration to said second configuration upon insertion of said pin in said first seat and upon rotation of said auxiliary drive system with respect to said wheelchair around an axis of rotation defined by said pin;

said main body with said locking mechanism being configured to be connected to said free end of said at least one longitudinal member and said pin and said driving element being configured to be connected to said auxiliary drive system or vice versa;

wherein said locking mechanism comprises:

a locking element which defines a housing between a first protrusion and a second protrusion, said locking element being rotatably associated with said main body by pin means having the axis of rotation substantially orthogonal to said advancement direction so that said locking element can assume a first position with respect to said main body whereby access to said second seat is allowed through said access mouth of said second seat and a second position whereby said first protrusion occludes said access mouth of said second seat;

a release element operatively associated with said main body and cooperating with said locking element in such a way that said release element can assume a first position thereof with respect to said main body that allows said locking element to switch from said first position to said second position or vice versa, and in such a way that said release element can assume a second position thereof which prevents said locking element from switching from said second position to said first position.

* * * * *